United States Patent [19]

Appleton

[11] Patent Number: 4,725,107

[45] Date of Patent: Feb. 16, 1988

[54] REFRIGERATOR WITH IMPROVED ACCESS

[76] Inventor: Arthur I. Appleton, 22 Indian Creek Island, Miami Beach, Fla. 33154

[21] Appl. No.: 502,563

[22] Filed: Jun. 9, 1983

[51] Int. Cl.[4] ..... A47B 81/00

[52] U.S. Cl. ..... 312/283; 312/116; 312/214

[58] Field of Search ..... 312/36, 214, 283, 284, 312/289, 236, 116

[56] References Cited

U.S. PATENT DOCUMENTS

| | | | |
|---|---|---|---|
| 774,136 | 11/1904 | Forbes | 312/283 X |
| 940,416 | 11/1909 | Young | 312/283 X |
| 1,242,235 | 10/1917 | Polk | 312/214 X |
| 1,369,338 | 2/1921 | Hillman | 312/214 |
| 1,984,977 | 12/1934 | Mize | 312/283 X |
| 2,584,886 | 2/1952 | Laguzzi | 312/214 |
| 2,618,527 | 11/1952 | Palmer | 312/214 X |
| 2,737,782 | 3/1956 | Antico | 312/214 X |
| 2,756,570 | 7/1956 | Gale | 312/36 X |
| 2,815,649 | 12/1957 | Angelus et al. | 312/214 |
| 4,123,130 | 10/1978 | Locke | 312/236 X |

FOREIGN PATENT DOCUMENTS

| | | | |
|---|---|---|---|
| 562083 | 6/1944 | United Kingdom | 312/283 |

*Primary Examiner*—Kenneth J. Dorner
*Assistant Examiner*—Thomas A. Rendos
*Attorney, Agent, or Firm*—Jones, Day, Reavis & Pogue

[57] ABSTRACT

A combination cooler-freezer or "refrigerator" includes a front door providing access to the refrigerated portions of its interior, and it also includes a side door providing access into the freezer portions of its interior. The size and placement of the freezer door provides an unusually large amount of access area into the freezer space, reduces its depth and thus increases the visibility of most of the items contained therein.

1 Claim, 2 Drawing Figures

REFRIGERATOR WITH IMPROVED ACCESS

BACKGROUND OF THE INVENTION

Refrigerators that include both cooler and freezer compartments frequently include two access doors mounted on their front. Models carrying two doors on their front have those doors arranged in various configurations. Some include upper and lower doors where one opens into the freezer compartment while the other opens into the cooler compartment. Other models have side-by-side doors for freezer and refrigerator compartments.

In all of these configurations the depth of all of the various compartments is very nearly equal to the overall depth of the refrigerator from front to rear. And, when the refrigerator is crowded with items to be kept cool, or frozen, items stored away from the door at the rear of the compartment frequently become forgotten and may spoil. This is particularly true for refrigerators with multiple doors in the front because each door must then be smaller, and one's vantage into the compartment is thus reduced. Furthermore, to remove an item from the rear of a conventional refrigerator, it may be necessary to remove many of the items in front of it first and later replace them after the desired item has been removed.

SUMMARY OF THE INVENTION

The primary objective of this invention is to so configure a refrigerator's external doors and internal space that objects stored therein are more readily accessible and are not as likely to become forgotten or lost in the rear thereof. In achieving this objective, a combination cooler-freezer or "refrigerator" includes at least one large door on its vertical front and another door on a different one of its vertical sides. The interior space within the overall cabinet is then divided by an internal wall so as to be much more accessible than in those refrigerators having one or more doors only on the front. In a preferred embodiment, the side door is of generous proportions and opens directly into the freezer compartment which is preferrably relatively shallow. Thus, essentially everything within the freezer is visible upon opening the door. The front door of the refrigerator preferrably conventionally opens to expose the cooling portion of the interior, and much of the available space in that compartment is also near the front of the refrigerator by virtue of the location of the freezer compartment. A portion of this cooler space, however, may necessarily be adjacent the rear of the refrigerator, but this portion can be adjusted to limited proportions by altering the size and shape of the freezer compartment.

There is thus disclosed herein an improved home refrigerator in the sense that it incorporates better space utilization than other known refrigerator configurations as well as better visibility and access to items contained therein.

DESCRIPTION OF PREFERRED EMBODIMENT

Figure 1:
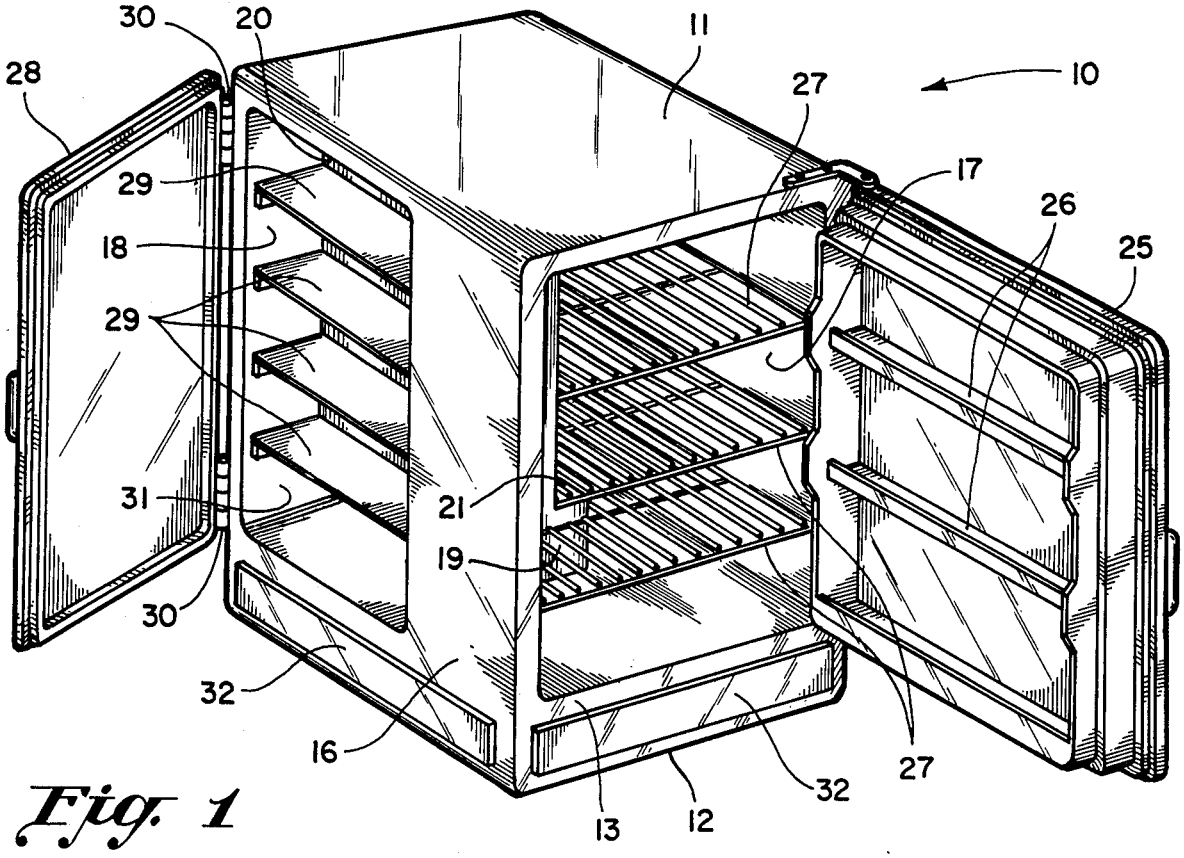
FIG. 1 is a perspective view of the refrigerator incorporating the principles of the present invention.
Figure 2:
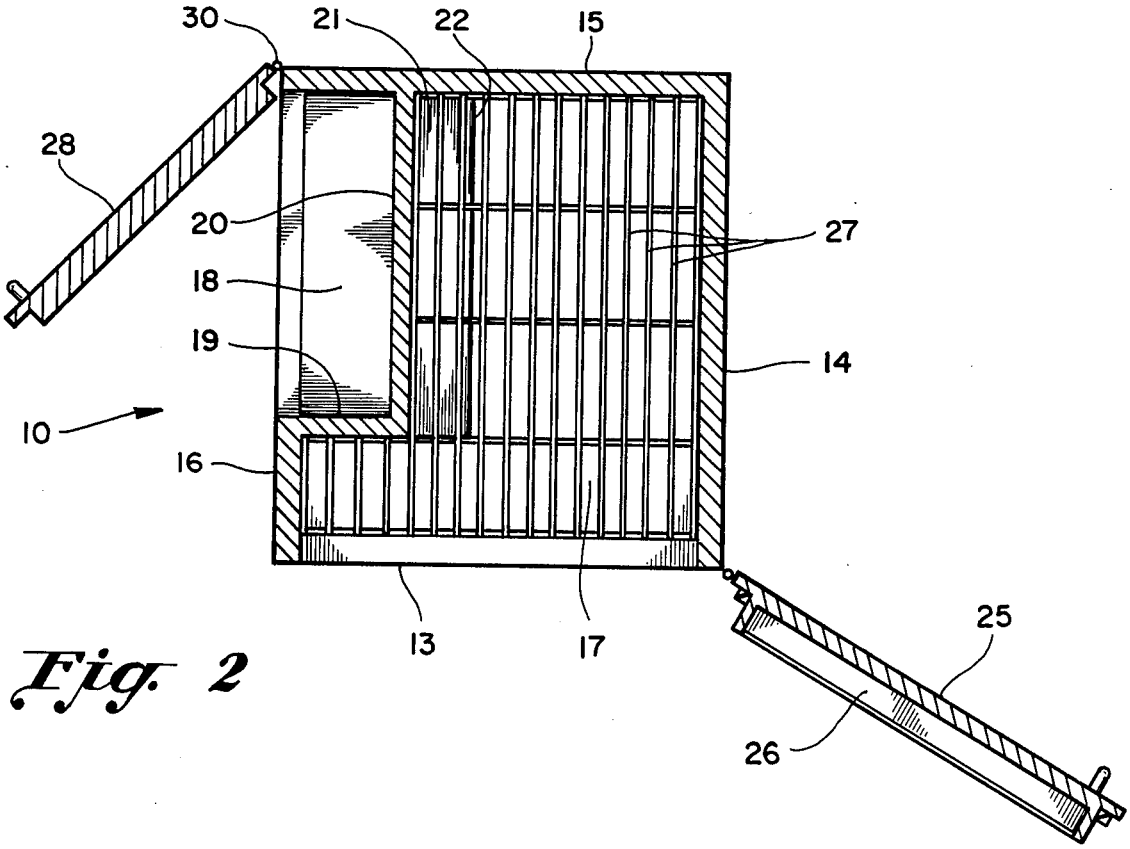
FIG. 2 is a cross sectional view of the refrigerator shown in FIG. 1 taken along a horizontal plane so as to clarify the internal layout of cooler and freezer compartments.

Referring now to the two figures, there is shown a combination cooler-freezer generally at 10, however as noted earlier, it will more simply and conventionally be referred to as a "refrigerator". Refrigerator 10 is primarily a hollow cabinet defining an enclosure for foodstuff or the like and has a top 11, a bottom 12, and four vertical sides 13–16 of which side 13 comprises the front. The interior of the cabinet is divided into two functional spaces comprising a cooler space or compartment 17 and a freezer space or compartment 18. These two spaces 17 and 18 are separated by internal partition means consisting of walls 19, 20, 21 and 22.

Pivotally mounted on the front of the refrigerator cabinet are door means 25 of conventional refrigerator door construction. If desired, several doors could be mounted on the cabinet front to access different cooler spaces, and if desired, each door may include internal shelves 26 conventionally therein. Door means 25 provides selective access into cooler compartment 17, and compartment 17 may contain food storage shelves 27.

Pivotally mounted on either one of the two sides 14 or 16 (herein shown mounted on side 16) are side door means 28 that swing open around vertically spaced hinges 30 to provide a side access to freezer compartment 18. Freezer compartment 18 also contains a plurality of food storage shelves such as those designated 29, and the bottom section 31 of the freezer compartment can be made extra deep if desired to hold such items as turkeys or a seven-rib roast.

All of the apparatus that operates to cool the refrigerator such as the pump, heat exchange paraphernalia and so forth can be conventionally located, and herein it is contemplated that it is located behind several panels 32 adjacent to bottom 12 of the cabinet.

As will be understood, this arrangement of doors provides a much greater degree of accessibility to items contained within the refrigerator. One large front door 25 both can hold large quantities of food on its own shelves, and it also opens up the entire front of the refrigerator so as to provide a large frontal exposure to the entire cooling section 17. And with the freezer space located behind a partition located largely at the rear of the cooler space, much of the available space in the cooler compartment is in its accessible forward portions adjacent door 25.

The freezer compartment also enjoys excellent accessibility by way of the relatively large door 28 and the relative shallowness of that compartment.

By increasing the access area into the refrigerator, in some cases to an area greater than the area of any one of the sides alone, and by also judiciously arranging the refrigerator's internal space, the interior of the refrigerator of this disclosure exhibits unparalled accessibility.

The foregoing disclosure was detailed to ensure adequacy and aid understanding, however this was not intended to prejudice that purpose of a patent which is to cover each new and inventive concept therein no matter how others may later disguise it by variations in form or additions or further improvements. Thus, the true breadth or scope of the invention is not to be defined and limited by the few drawings selected to representatively illustrate its principles, buy rather by the language used in the claim when given its broadest, reasonable interpretation.

I claim:

1. Improvements in refrigerator design for providing greater accessibility to its contents, comprising:

a substantially hollow refrigerator cabinet having a front and a rear separating two sides that in part enclose an internal cooler space, said internal cooler space being accessible from the front and including shelf space extending substantially the entire width of the refrigerator for a portion of the refrigerator's depth from said front, said shelf space also extending substantially to the rear of the refrigerator for a portion of the refrigerator's width;

front door means pivotally mounted on said cabinet about a vertical axis for selectively exposing or closing off access into said cooler space;

internal partition means within said cabinet for limiting the width of the cooler space away from said front, for defining a freezer space disposed toward the rear of the refrigerator and also for separating the freezer space from the cooler space, said freezer space being relatively shallow and opening outwardly on one of said two sides so as to be accessible therefrom but so positioned relative to the front of the cabinet as to not interfere with the width of the cooler space immediately behind the front door means;

and side door means being pivotally mounted on said cabinet about a vertical axis near the rear of said cabinet for selectively exposing or closing off access into said freezer space, said side door means extending over a substantial portion of the height of said cabinet.

* * * * *